US009401102B2

(12) United States Patent
Misawa et al.

(10) Patent No.: US 9,401,102 B2
(45) Date of Patent: Jul. 26, 2016

(54) SIGN INCLUDING A PLURALITY OF SYMBOL PORTIONS

(71) Applicant: KABUSHIKI KAISHA TOKAI-RIKA-DENKI-SEISAKUSHO, Aichi-ken (JP)

(72) Inventors: Taiki Misawa, Aichi-ken (JP); Seiji Hayashi, Aichi-ken (JP)

(73) Assignee: KABUSHIKI KAISHA TOKAI-RIKA-DENKI-SEISAKUSHO, Aichi-Ken (JP)

( * ) Notice: Subject to any disclaimer, the term of this patent is extended or adjusted under 35 U.S.C. 154(b) by 0 days.

(21) Appl. No.: 14/600,582

(22) Filed: Jan. 20, 2015

(65) Prior Publication Data

US 2015/0206463 A1 Jul. 23, 2015

(30) Foreign Application Priority Data

Jan. 23, 2014 (JP) ..... 2014-010751

(51) Int. Cl.

| | |
|---|---|
| ***G09F 7/00*** | (2006.01) |
| ***G09F 7/16*** | (2006.01) |
| ***G09F 21/04*** | (2006.01) |
| ***G09F 7/14*** | (2006.01) |
| *G09F 7/18* | (2006.01) |

(52) U.S. Cl.

CPC .. *G09F 7/16* (2013.01); *G09F 7/14* (2013.01); *G09F 21/04* (2013.01); *G09F 2007/1856* (2013.01); *G09F 2007/1865* (2013.01); *G09F 2007/1882* (2013.01)

(58) Field of Classification Search

CPC ..... G09F 7/14; G09F 7/16

USPC ..... 40/596

See application file for complete search history.

(56) References Cited

U.S. PATENT DOCUMENTS

| | | | | |
|---|---|---|---|---|
| 2,124,440 | A * | 7/1938 | Tallberg | 40/618 |
| 2,257,200 | A * | 9/1941 | Smith | 434/365 |
| 2,399,029 | A * | 4/1946 | Hoag | 40/623 |
| 3,059,363 | A * | 10/1962 | Mack | 40/618 |

(Continued)

FOREIGN PATENT DOCUMENTS

| | | |
|---|---|---|
| GB | 1245385 A | 9/1971 |
| GB | 2187092 A | 9/1987 |

(Continued)

OTHER PUBLICATIONS

Extended European Search Report Application No. 15151892.5-1801 dated Jun. 26, 2015.

(Continued)

*Primary Examiner* — Shin Kim

(74) *Attorney, Agent, or Firm* — Roberts Mlotkowski Safran & Cole P.C.

(57) ABSTRACT

A sign is provided capable of increasing strength. A sign includes plural symbol portions arrayed in an array direction. Blank regions with an enclosed shape, and blank regions with an opened shape opening in the array direction, are formed inside the symbol portions. Reinforcement portions are provided at the blank regions. The symbol portions are coupled together by coupling portions, and the coupling portions are provided such that an array width direction position of the coupling portions coincides with an array width direction position of the reinforcement portions.

13 Claims, 15 Drawing Sheets

(56) References Cited

U.S. PATENT DOCUMENTS

| | | | | |
|---|---|---|---|---|
| 4,027,412 | A * | 6/1977 | Hoerner | 40/618 |
| 4,155,185 | A * | 5/1979 | Lemelson | 40/623 |

FOREIGN PATENT DOCUMENTS

| | | |
|---|---|---|
| GB | 2481813 | 1/2012 |
| JP | 10-053895 | 2/1998 |

OTHER PUBLICATIONS

Lihao Chrome Logo Manufactory "Chrome car logo" dated Apr. 1, 2012.

Lihao Chrome Logo Manufactory "Chrome car logo" dated Jun. 26, 2012.

European Search Report Application No. EP 15151892.5-1801 dated Apr. 29, 2016.

* cited by examiner

SIGN INCLUDING A PLURALITY OF SYMBOL PORTIONS

CROSS-REFERENCE TO RELATED APPLICATION

This application claims priority under 35 USC 119 from Japanese Patent Application No. 2014-010751 filed Jan. 23, 2014, the disclosure of which is incorporated by reference herein.

BACKGROUND

1. Field of the Invention

The present invention relates to a sign.

2. Related Art

Japanese Patent Application Laid-Open (JP-A) No. H10-53895 describes an ornamental member applied to a vehicle exterior decor of a car or the like. The ornamental member is employed as an emblem of formed or molded logo of the car manufacturer or text displaying name of the model of the car or the like, for example. The emblem is configured by arraying plural characters, and the characters are coupled together by coupling portions provided between the characters.

In the emblem, the coupling portions are provided so as to coincide at positions of upper edges of the characters. There is accordingly room for improvement in the strength of the characters and in the coupling strength between the characters and the coupling portions.

SUMMARY

In consideration of the above circumstances, a sign capable of increasing strength is provided.

A sign according to a first aspect of the present invention includes a plurality of symbol portions that are arrayed in an array direction along which the plurality of symbol portions are arrayed; a reinforcement portion that is provided at a blank region and that reinforces the symbol portion, the blank region being formed by the symbol portion with a periphery thereof being enclosed or with being opened in the array direction in plan view; and a coupling portion that couples the symbol portions together, the coupling portion being provided between the symbol portions such that a position of the coupling portion and a position of the reinforcement portion coincide with each other in an array width direction which is orthogonal to the array direction.

In the sign according to the first aspect, the plural symbol portions are arrayed in the array direction. The coupling portion is provided between the symbol portions and couple the symbol portions together.

The reinforcement portion is provided at the blank region formed by the symbol portion. The rigidity at a location along the blank region of the symbol portion is accordingly raised by the reinforcement portion, thereby enabling an increase in the strength of the symbol portions. In addition, the coupling portion is provided such that the position of the coupling portion and the position of the reinforcement portion coincide with each other in the array width direction. The symbol portion is accordingly coupled by the coupling portion at the location where the strength is reinforced, enabling an increase in the strength of the overall sign.

A sign according to a second aspect of the invention is the sign according to the first aspect, wherein a center position in the array width direction of the coupling portion coincides with a center position in the array width direction of the reinforcement portion.

In the sign according to the second aspect, the array width direction center position of the coupling portion and the array width direction center position of the reinforcement portion are coincide with each other, such that the shapes of both the reinforcement portion and the coupling portion have substantial line symmetry about the array width direction center position. This enables the design characteristics of the sign to be improved.

A sign according to a third aspect of the invention is the sign according to either the first aspect or the second aspect, wherein the blank regions are provided at the symbol portion on both sides with respect to a center position in the array width direction of the symbol portion, and the reinforcement portion is provided at one of the blank regions, a position in the array width direction of the one of the blank regions coinciding with a position in the array width direction of the coupling portion.

According to the third aspect of the invention, the respective blank regions are provided at the symbol portion on the both sides with respect to the array width direction center position of the symbol portion, and the reinforcement portion is provided at the one of the blank regions, the position in the array width direction of the one of the blank regions coinciding with the position in the array width direction of the coupling portion. The coupling portion and the reinforcement portion are thus disposed contiguously in a straight line along the array direction. This enables an improvement to the design characteristics of the sign.

A sign according to a fourth aspect of the invention is the sign according to any one of the first aspect to the third aspect, wherein a design of the reinforcement portion and of the coupling portion differs from a design of the symbol portion.

According to the fourth aspect of the invention, since the design of the reinforcement portion and the coupling portion is different to the design of the symbol portion, outline of the symbol portion is made clearer against the reinforcement portion and the coupling portion. This enables the visibility of the symbol portion to be improved.

A sign according to a fifth aspect of the present invention is the sign according to the fourth aspect, wherein the symbol portion, the reinforcement portion, and the coupling portion are attachable to an attachment body, and the design of the reinforcement portion and of the coupling portion matches a design of the attachment body at a periphery of the reinforcement portion and the coupling portion.

In the sign according to the fifth aspect, the design of the reinforcement portion and the coupling portion matches the design of the attachment body peripheral to the reinforcement portion and the coupling portion. The reinforcement portion and the coupling portion are accordingly not noticeable against a surface of the attachment body, and so the outline of the symbol portion is made clearer. This enables the visibility of the symbol portion to be improved.

In the above aspects, it is possible that a width in the array width direction of the coupling portion is the same as a width in the array width direction of the reinforcement portion.

The sign described above exhibits the excellent advantageous effect of enabling an increase in strength.

BRIEF DESCRIPTION OF THE DRAWINGS

Exemplary embodiments of the invention will be described in detail with reference to the following figures, wherein:

FIG. 1A is a front view of a sign with symbol portions configured by upper case letters, and FIG. 1B is a front view of a sign with symbol portions configured by numbers;

FIG. 5A is a front view of a sign with symbol portions configured by upper case letters, FIG. 5B is a front view of a sign with symbol portions configured by lower case letters, and FIG. 5C is a front view of a sign with symbol portions configured by numbers;

FIG. 7A is a front view of a sign including a symbol portion shown in FIG. 1A and a symbol portion shown in FIG. 5A, and FIG. 7B is a front view of a sign including a symbol portion shown in FIG. 5C and a symbol portion shown in FIG. 1B;

FIG. 8A is a front view of a sign with symbol portions configured by upper case letters, FIG. 8B is a front view of a sign with symbol portions configured by lower case letters, and FIG. 8C is a front view of a sign with symbol portions configured by numbers;

DETAILED DESCRIPTION

First Exemplary Embodiment

Figure 1A:
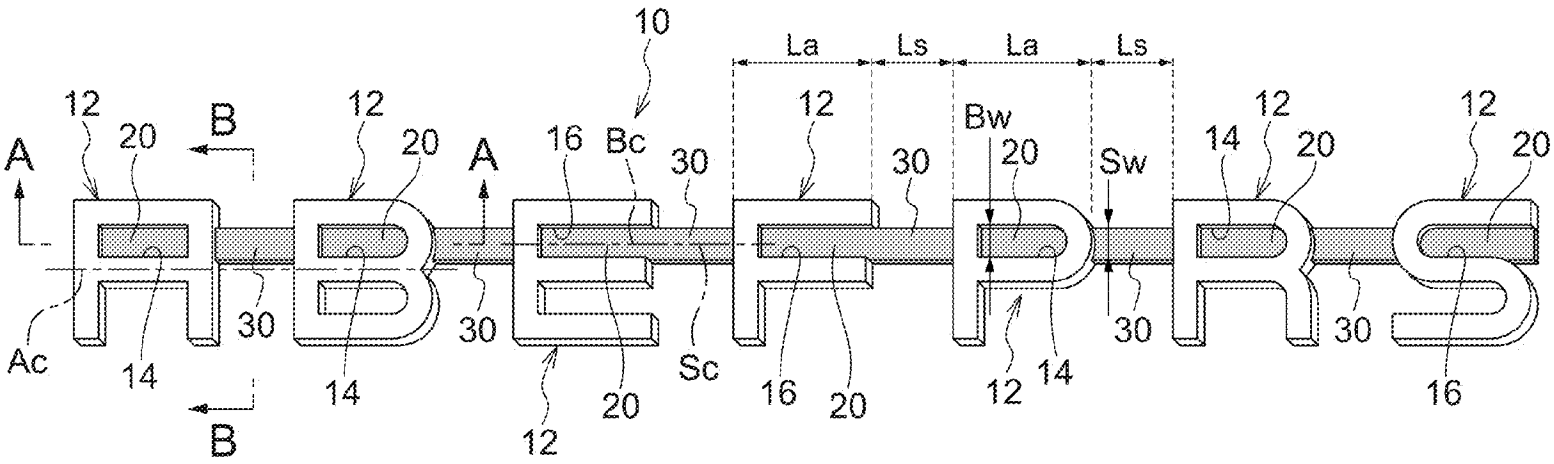
FIGS. 1A and 1B are front views of signs according to a first exemplary embodiment of the present invention.

Explanation follows regarding a sign according to a first exemplary embodiment of the present invention, with reference to FIGS. 1A, 1B, 2, 3A, 3B, 4A, 4B. Note that for ease of explanation, in the drawings the arrow X direction indicates an array direction or an array width direction of a symbol portion of the sign, and the arrow Y direction indicates an array width direction or an array direction of the sign, as appropriate. The arrow Z direction indicates the thickness direction of the sign. Note that there is no limitation to the direction in which the sign is applied to a vehicle or the like.

Sign Configuration with Upper Case Letters as Symbol Portions

As shown in FIG. 1A, a sign 10 according to the present exemplary embodiment includes plural symbol portions 12 arrayed in a straight line with the array direction along which the plural symbol portions 12 are arrayed in the arrow X direction. Symbol portions 12 adjacent to each other in the array direction are spaced at uniform intervals apart from each other in the present exemplary embodiment, and are coupled together by coupling portions 30, referred to as bridges. Regions in the array direction (array direction regions) corresponding to the symbol portions 12 are indicated by the reference numerals La, and in the same direction, regions corresponding to the coupling portions 30 are indicated by the reference numerals Ls.

In the sign 10 of the present exemplary embodiment, the symbol portions 12 are configured by principal upper case letters (capital letters of the Roman alphabet). More specifically, the sign 10 is configured by arraying of symbol portions 12 for the upper case letters "A", "B", "E", "F", "P", "R", and "S". Blank regions (space regions) 14 with an enclosed shape (a periphery enclosed shape) (more specifically, enclosed shape enclosed by a symbol body 12A, which will be described below, of the symbol portion 12) are provided inside the symbol portions 12 for the upper case letters "A", "B", "P", and "R" in a plan view (seen in a thickness direction of the symbol portion). In the present exemplary embodiment, reinforcement portions 20 are provided at the blank regions 14 which are positioned at upper portions of the symbol portions 12 in the array width direction which is orthogonal to the array direction, corresponding to the arrow Y direction. Blank regions (space regions) 16 with an opened shape (more specifically, opened shape formed by the symbol body 12A of the symbol portion 12) opening in the array direction (the arrow X direction and the opposite direction to the arrow X direction) are provided inside the symbol portions 12 for the upper case letters "E", "F", and "S" in a plan view. Similarly to the blank regions 14, in the present exemplary embodiment the reinforcement portions 20 are provided at the blank regions 16 which are positioned at upper portions of the symbol portions 12 in the array width direction. The symbol portions 12 for the upper case letters "B", "E", and "S" include the blank regions 14 or the blank regions 16 at both upper and lower sides with respect to center position Ac in the array width direction (referred to below as halfway position of the symbol height Lh). In the present exemplary embodiment, the reinforcement portions 20 are only provided at the blank regions 14 and the blank regions 16, which are positioned in the array width direction upper portions.

Figure 4A:
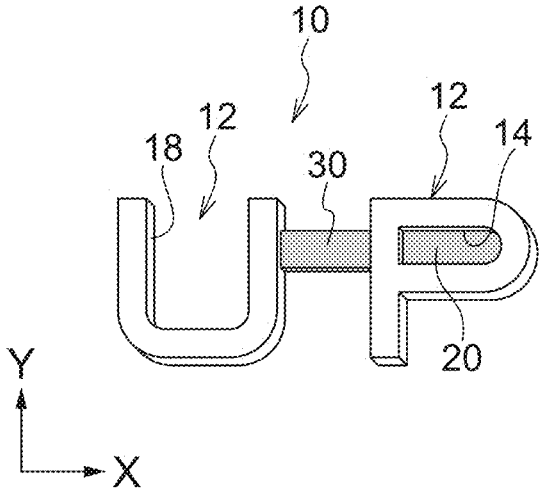
FIG. 4A is a front view of a sign including a symbol portion shown in FIG. 1A and another symbol.

The upper case letters configuring the sign 10 are not limited to the symbol portions 12 for "A" etc. described above, and the sign 10 may be configured including symbol portions 12 for other upper case letters. As shown in FIG. 4A, the sign 10 may for example include a symbol portion 12 for the letter "U" that is another upper case letter. A blank region 18 with a shape opening in the array width direction, not in the array direction, is provided inside the symbol portion 12 for the upper case letter "U". The blank region 18 is not provided with a reinforcement portion 20. Symbol portions 12 for other upper case letters "H", "V", "W", "X", and "Y" and the like, omitted from illustration, are not provided with reinforcement portions 20 at their respective blank regions thereinside, similarly to the symbol portion 12 for the another upper case letter "U". Blank regions with an opened shape opening in the array direction are provided in the symbol portions 12 for other upper case letters, not shown in the drawings, "C" and "G" and the like, and blank regions with an enclosed shape (a periphery enclosed shape) are provided inside the symbol portions 12 for yet other upper case letters, not shown in the drawings, "D" and "O" and the like. The symbol portions 12 for these upper case letters each include a single blank region; however the reinforcement portions 20 are not provided at these respective blank regions. Such symbol portions 12 are distinguished from the symbol portions 12 for the upper case letters "A" etc. provided with the blank regions 14 or the blank regions 16 on both sides with respect to the array width direction center position Ac. Moreover, there are no blank regions inside the symbol portions 12 for other upper case letters such as "I" and "T", and so the reinforcement portions 20 are not provided.

Figure 2:
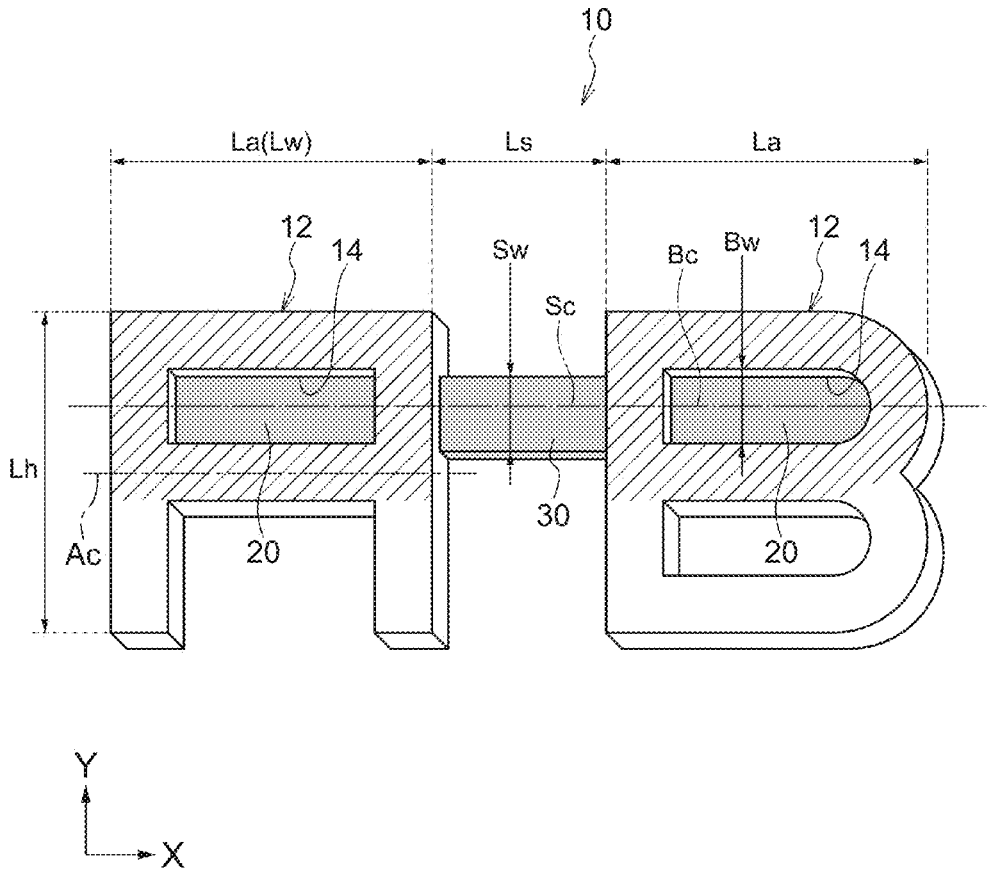
FIG. 2 is an enlarged front view of relevant portions of the sign shown in FIG. 1A.
Figure 3A:
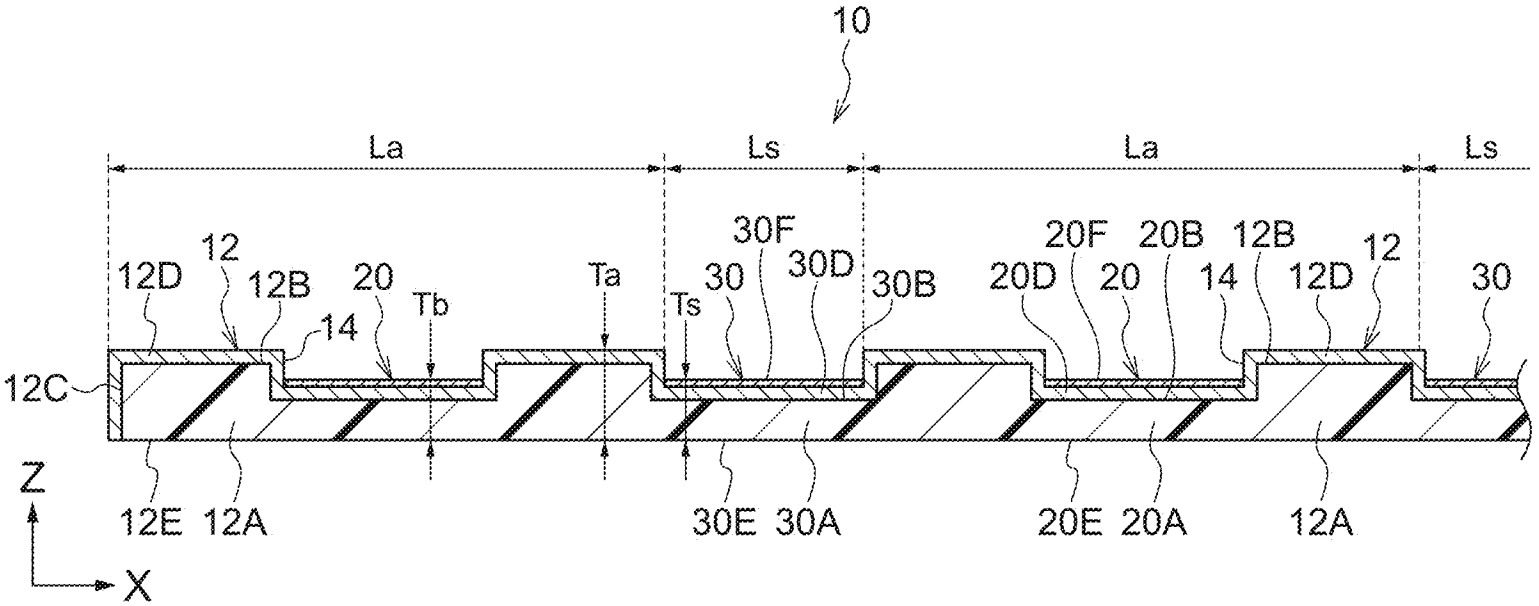
FIG. 3A is a cross-section of a sign taken along an array direction (along line A-A) of the symbol portions shown in FIG. 1A.
Figure 3B:
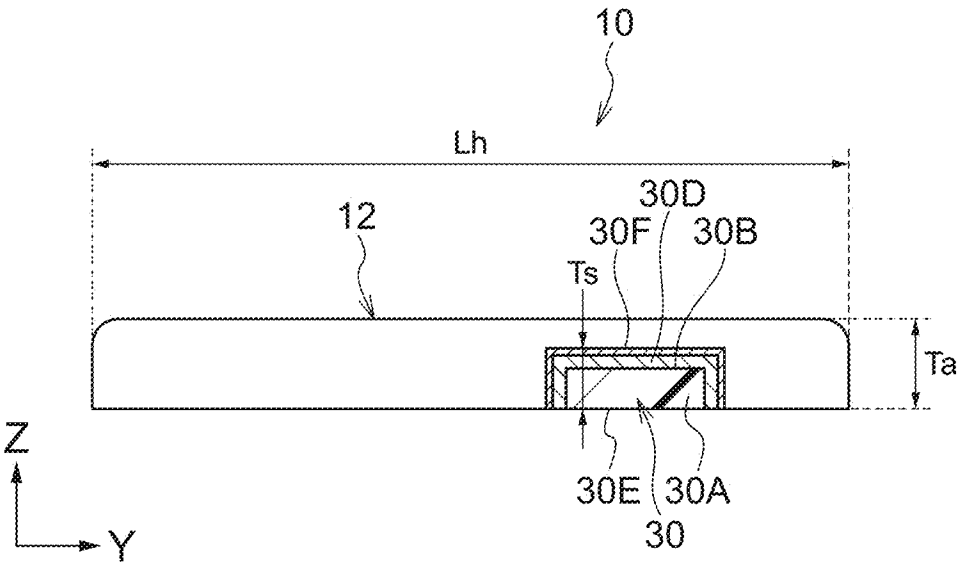
FIG. 3B is a side view and partial cross-section of a sign taken along an array width direction (along line B-B) of a symbol portion shown in FIG. 1A.

As shown in FIG. 2, the symbol portions 12 have a symbol width Lw (corresponding to (same as) the region La) in a direction same as the array direction and a symbol height Lh in a direction same as the array width direction. As shown in FIG. 3A and FIG. 3B, each symbol portion 12 has a symbol thickness Ta in a direction same as the arrow Z direction. The respective symbol portions 12 each include a symbol body 12A formed with a uniform thickness across the symbol width Lw direction and the symbol height Lh direction, and the symbol body 12A is, for example, formed by injection molding a colored or colorless resin material. In the present exemplary embodiment, a front face 12B and side faces 12C, serving as design faces of the symbol body 12A, are provided with a surface-processed layer 12D, and a back face 12E configuring an attachment face (or adhesion face) to the vehicle at the opposite side to the front face 12B (facing the front face 12B) is not provided with the surface-processed layer 12D. The surface-processed layer 12D is, for example, formed by chrome plating having silver gloss. Note that the surface-processed layer 12D is not limited to chrome plating, and may be configured by plating other than with chrome, or by a coating or the like. The surface-processed layer 12D may also be configured by applying texturing (embossing) to the surface of the symbol body 12A to give a leather pattern, a wood grain pattern, a stone finish pattern, a grainy pattern, a satin finish pattern, or a geometric pattern, for example. The surface-processed layer 12D may also be provided to the back face 12E of the symbol body 12A. Such a case eliminates the effort of performing masking or the like, enabling simplification of forming of the surface-processed layer 12D. At least a surface-processed layer 20D and a surface-processed layer 30D, described later, may be respectively provided to a back face 20E and a back face 30E, similarly to the surface-processed layer 12D.

As shown in FIG. 3A, the reinforcement portions 20 each includes a reinforcement body 20A configured integrally with the symbol bodies 12A. A reinforcement thickness (thickness in the arrow Z direction) Tb of the reinforcement portion 20 has a different thickness to the symbol thickness Ta, and is set thinner than the symbol thickness Ta in the present exemplary embodiment. The reinforcement body 20A is formed from a resin material similarly to the reinforcement body 20A. A front face 20B configuring a design face of the reinforcement body 20A is provided with a surface-processed layer 20D that is configured integrally with, and is the same as (formed during the same manufacturing process as), the surface-processed layer 12D. A back face 20E, on the opposite side to the front face 20B (facing the front face 20B), of the reinforcement body 20A is not provided with the surface-processed layer 20D. Moreover, the front face of the surface-processed layer 20D is provided with a surface-processed layer 20F which is different to the surface-processed layer 20D. The surface-processed layer 20F is, for example, configured by a color-coated layer, and is a black coated layer in the present example. Note that instead of being a color-coated layer, the surface-processed layer 20F may be configured by applying different texturing to that of the surface-processed layer 12D of the symbol portion 12.

As shown in FIG. 2, in, for example, the symbol portion 12 for the upper case letter "A", rather than being triangular, the shape of the array width direction upper portion is configured in a rectangular shape stretched out in the array direction so as to have the same dimension as the symbol width La. Due thereto, the shape of the blank region 14, the blank region 16 being thereby configured as a rectangular shape with length direction in the array direction, and the reinforcement portion 20 being provided to the blank region 14, the blank region 16. The symbol portion 12 is preferably configured as a whole with rectangular shaped letter form (style of type).

As shown in FIG. 1A and FIG. 2, the array width direction position of the coupling portion 30 between symbol portions 12 adjacent in the array direction, coincides with (is aligned with) the array width direction positions of the reinforcement portions 20, and in the present example, the coupling portion 30 is provided with the same width as the reinforcement portions 20. More specifically, an array width direction coupling width (width in the array width direction) Sw of the coupling portion 30 is the same as an array width direction reinforcement width (width in the array width direction) Bw of the reinforcement portions 20. A center position (center line) Sc of the coupling width Sw coincides with a center position (center line) Bc of the reinforcement width Bw. Note that, the definition of the term "the same" or "coincide" means to include "being exactly the same" or "exactly coincide", and also includes variation within a permissible range of processing variation or the like.

As shown in FIG. 2, FIG. 3A and FIG. 3B, the coupling portions 30 each include a coupling body 30A configured integrally with the respective symbol bodies 12A. In the present example, a coupling thickness (thickness in the arrow Z direction) Ts of the coupling portion 30 is the same as the thickness of the reinforcement thickness Tb. The cross-section structure of the coupling portion 30 is the same as the cross-section structure of the reinforcement portion 20. Namely, the coupling bodies 30A are configured integrally with the symbol bodies 12A. Moreover, front faces 30B and side faces 30C configuring design faces of the coupling body 30A are provided with a surface-processed layer 30D which is the same as the surface-processed layer 20D, and a front face of the surface-processed layer 30D is provided with a surface-processed layer 30F which is as the same as the surface-processed layer 20F. In the present exemplary embodiment, a back face 30E at the opposite side to the front face 30B (facing the front face 30B) is not provided with the surface-processed layer 30D.

Figure 4B:
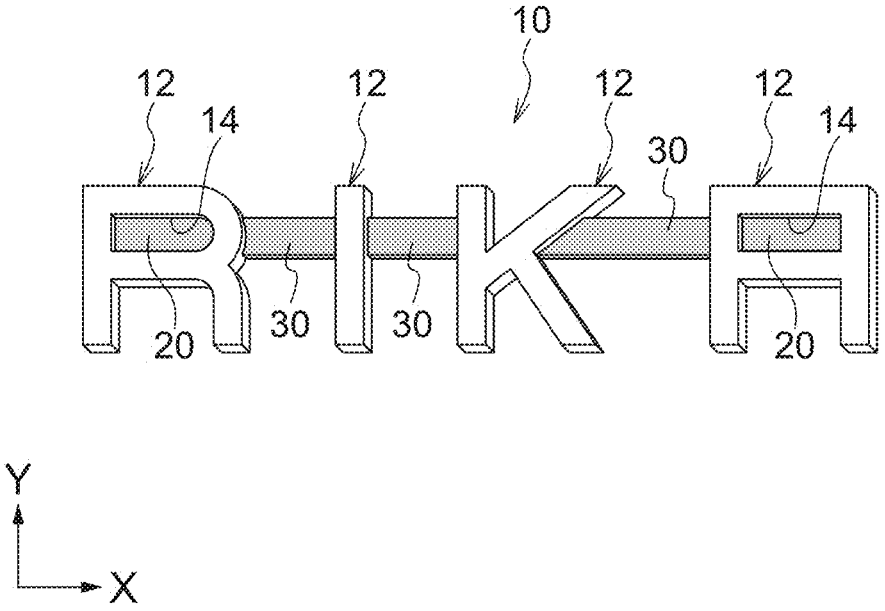
FIG. 4B is a front view of another sign.

In a case in which, for example, the symbol portion 12 for the upper case letter "U" that may be not a principal upper case letter is included in the sign 10, as shown in FIG. 4A, the coupling portion 30 is coupled directly to the symbol portion 12 for the other upper case letter "U", without varying the array width direction position of the coupling portion 30. Similarly, in a case in which, for example, the sign 10 includes the symbol portions 12 for the other upper case letters "K" and "I" to spell "RIKA" as shown in FIG. 4B, the coupling portions 30 are coupled directly to the symbol portions 12 for the other upper case letters "K" and "I", without varying the array width direction position of the coupling portions 30.

Note that in the symbol portions 12 for upper case letters shown in FIG. 1A, the reinforcement portions 20 are provided to all of the blank regions 14 and all of the blank regions 16 at the array width direction upper portion along the array direction. In the present exemplary embodiment, the reinforcement portions 20 may also be provided to some of the blank regions 14 and blank regions 16 of the symbol portions 12. For example, in the symbol portions 12 for the upper case letters "A", "B", and "E" arrayed on the left hand side, the reinforcement portions 20 may be provided to the blank region 14 and the blank region 16 of the respective symbol portions 12 for the upper case letters "A" and "E", without providing a reinforcement portion 20 to the blank region 14 of the symbol portion 12 for the upper case letter "B". Moreover, the symbol portions 12 for upper case letters are spaced at uniform intervals apart from each other in the array direction; however some of intervals in the array direction may be varied in the present exemplary embodiment. All of the symbol portions 12 for upper case letters have the same symbol width Lw and symbol height Lh as each other, however the present invention may include some symbol portions 12 in which the symbol width Lw and/or the symbol height Lh have been varied.

Sign Configuration with Numbers as Symbol Portions

Figure 1B:
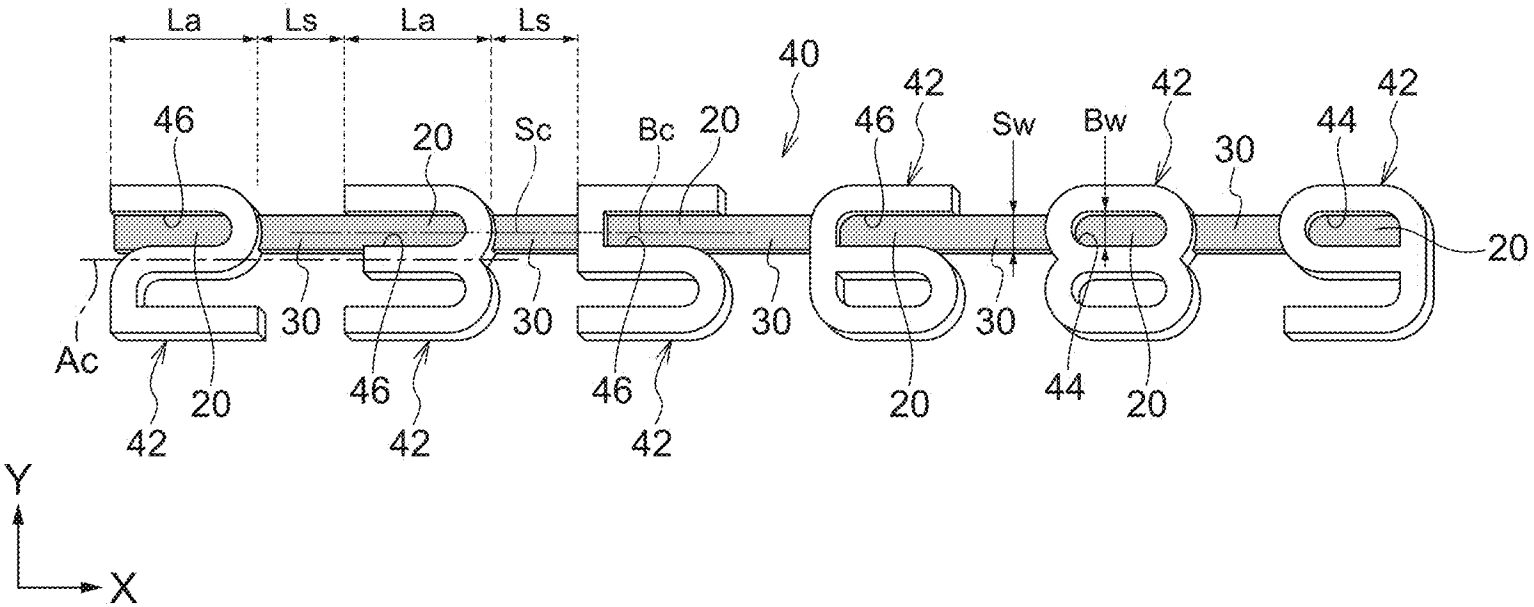

A sign 40 according to the first exemplary embodiment shown in FIG. 1B includes plural symbol portions 42 arrayed in a straight line with the array direction in the arrow X direction, similarly to in the sign 10. Symbol portions 42 adjacent to each other in the array direction are spaced at uniform intervals apart from each other, and are coupled together by coupling portions 30. Similarly to the sign 10, in the sign 40, regions in the array direction (array direction regions) corresponding to the symbol portions 42 are indicated by the reference numerals La, and regions corresponding to the coupling portions 30 in the same direction are indicated by the reference numerals Ls.

In the sign 40 of the present exemplary embodiment, the symbol portions 42 are configured by principal numbers (Arabic numerals). More specifically, the sign 40 is configured by arraying symbol portions 42 for the numbers "2", "3", "5", "6", "8", and "9". Blank regions 44 with closed shape (periphery enclosed shape) are provided inside the symbol portions 42 for the numbers "8" and "9". In the present exemplary embodiment, reinforcement portions 20 are provided in the blank regions 44 positioned in array width direction upper portions of the symbol portions 42. Note that although blank regions with closed shapes are provided at array width direction lower portions inside the symbol portions 42 for the numbers "6" and "8", reinforcement portions 20 are not provided to these blank regions. Moreover, blank regions 46 with an opened shape opening in the array direction (the arrow X direction and the opposite direction to the arrow X direction) are provided inside the symbol portions 42 for the numbers "2", "3", "5", and "6". Similarly to the blank regions 44, in the present exemplary embodiment, reinforcement portions 20 are provided in the blank regions 46 positioned in array width direction upper portions of the symbol portions 42. Note that blank regions with open shapes are also provided at array width direction lower portions inside the symbol portions 42 for the numbers "2", "3", "5", and "9"; however reinforcement portions 20 are not provided at these blank regions.

The numbers configuring the sign 40 are not limited to the symbol portions 42 for "2" etc. described above, and symbol portions 42 may also be included for the other numbers "1", "4", "7", and "0", not shown in the drawings. Note that blank regions with an enclosed shape are also provided inside the respective symbol portions 42 for the numbers "4" and "0", however reinforcement portions 20 are not provided to these blank regions. Moreover, a blank region with an opened shape opening in both the array direction and the array width direction is provided inside the symbol 42 for the number "7", however a reinforcement portion 20 is not provided to this blank region. The symbol 42 for the number "1" does not have a blank region, and so a reinforcement portion 20 is not provided.

Similarly to the coupling portions 30 of the sign 10, the array width direction position of the coupling portion 30 between symbol portions 42 adjacent in the array direction, coincides with (is aligned with) the array width direction positions of the reinforcement portions 20, and in the present example, the coupling portion 30 is provided with the same width as the reinforcement portions 20. More specifically, an array width direction coupling width Sw of the coupling portion 30 is the same as an array width direction reinforcement width Bw of the reinforcement portions 20. A center position Sc of the coupling width Sw coincides with a center position Bc of the reinforcement width Bw.

The cross-section structures of the symbol portions 42, the reinforcement portions 20, and the coupling portions 30 of the sign 40 are the same as the cross-section structures of the symbol portions 12, the reinforcement portions 20, and the coupling portions 30 of the sign 10 shown in FIG. 3A and FIG. 3B.

Operation and Advantageous Effects of the Present Exemplary Embodiment

As shown in FIG. 1A, in the sign 10 according to the present exemplary embodiment plural of the symbol portions 12 for upper case letters are arrayed in the array direction. The coupling portions 30 are provided between the symbol portions 12, and the symbol portions 12 are coupled together by the coupling portions 30.

The reinforcement portions 20 are provided at the respective blank regions 14 or blank regions 16 of the symbol portions 12. The rigidity of location along or around the blank region 14 and the blank region 16 (the hatched region in FIG. 2) of the symbol portion 12 is thereby increased by the reinforcement portion 20, enabling an increase in the strength of the symbol portion 12. Additionally, as shown in FIG. 2 in particular, the coupling portion 30 is provided at the position in the array width direction, which is the same as the positions in the array width direction of the reinforcement portions 20. The sites where the strength of the symbol portions 12 are reinforced (the hatched regions in FIG. 2) are thus coupled by the coupling portion 30, enabling an increase in strength of the overall sign 10. The sign 10 of the present exemplary embodiment accordingly enables an increase in strength. Note that in the sign 40 according to the present exemplary embodiment shown in FIG. 1B, the symbol portions 42 are configured by numbers; similar operation and advantageous effects can be obtained to the operation and advantageous effects obtained by the sign 10.

In the sign 10 according to the present exemplary embodiment, the reinforcement portions 20 and the coupling portions 30 are set at the same position, and with the same widths (the reinforcement width Bw and the coupling width Sw), in the array width direction. The reinforcement portions 20 and the coupling portions 30 are accordingly connected in a straight line shape along the array direction of the symbol portions 12, enabling a sense of uniformity in the overall form of the reinforcement portions 20 and the coupling portions 30, and in the overall form of the symbol portions 12, thereby enabling improved design characteristics.

In the sign 10 according to the present exemplary embodiment, as shown in FIG. 2 in particular, the center position Bc of the reinforcement portions 20 and the center position Sc of the coupling portions 30 are the same in the array width direction. The array width direction shapes of the reinforcement portions 20 and the coupling portions 30 therefore have substantial line symmetry about the center position Bc and the center position Sc respectively. This enables a further improvement to the design characteristics of the sign 10. A further improvement to the design characteristics is likewise enabled in the sign 40, similarly to in the sign 10.

Moreover, in the sign 10 according to the present exemplary embodiment, the blank regions 14 and the blank regions 16 are provided on both sides with respect to the array width direction center positions Ac of the symbol portions 12, and the reinforcement portions 20 are provided to the blank regions 14 and/or the blank regions 16 at the one side, whose array width direction positions are the same as the array width direction positions the coupling portions 30. The coupling portions 30 and reinforcement portions 20 are thereby disposed contiguously in a straight line along the array direction, enabling an improvement in the design characteristics of the sign 10.

In the sign 10 according to the present exemplary embodiment, as shown in FIG. 3A and FIG. 3B, the design of the reinforcement portions 20 and the coupling portions 30 differs from the design of the symbol portions 12. More specifically, in the present example the design faces of the symbol portions 12 are configured with the surface-processed layer 12D formed by chrome plating, and the surface-processed layer 20F configuring the design faces of the reinforcement portions 20, and the surface-processed layer 30F configuring the design faces of the coupling portions 30 are configured by color-coated layers or texturing. The outlines of the symbol portions 12 are accordingly made clearer against the reinforcement portions 20 and the coupling portions 30, making the symbol portions 12 easier to read, and improving the visibility of the symbol portions 12. Note that the sign 40 according to the present exemplary embodiment shown in FIG. 1B can also obtain the operation and advantageous effects of improving visibility, similarly to the operation and advantageous effects obtained by the sign 10 according to the present exemplary embodiment.

As described above, the sign 10 according to the present exemplary embodiment enables an increase in overall strength, including that of the symbol portions 12 and the coupling portions 30. The line thickness for the upper case letters of the symbol portions 12, for example, can accordingly be made thinner, enabling an increase in the degrees of freedom for design characteristics. Note that the sign 40 according to the present exemplary embodiment can also obtain the operation and advantageous effects of enabling an increase in the degrees of freedom for design characteristics, similarly to the operation and advantageous effects obtained by the sign 10 according to the present exemplary embodiment.

As shown in FIG. 3A, in the sign 10 according to the present exemplary embodiment, the reinforcement portions 20 are provided to the blank regions 14 and the blank regions 16 of the symbol portions 12. A step between the front face 12B of the symbol body 12A of the symbol portion 12, and the front face 20B of the reinforcement body 20A of the reinforcement portion 20 is accordingly reduced. In the present exemplary embodiment, the surface-processed layer 12D and the surface-processed layer 20D are formed by chrome plating. The reduction in the step mentioned above improves entering (circulation) of the chrome plating fluid in the blank regions 14 and the blank regions 16, enabling the chrome plating fluid to reach corners of step portions, and thereby enabling an improvement in the finish quality of the surface-processed layer 12D and the surface-processed layer 12D. For example, unevenness and plating defects are eliminated, enabling a bright gloss silver finish for the chrome plating layer. The sign 40 according to the present exemplary embodiment can likewise obtain similar operation and advantageous effects as the operation and advantageous effects obtained by the sign 10 according to the present exemplary embodiment.

Second Exemplary Embodiment

Explanation follows regarding signs according to a second exemplary embodiment of the present invention, with reference to FIGS. 5A, 5B, 5C and FIGS. 6A, 6B, 6C. Note that in the second exemplary embodiment and thereafter mentioned exemplary embodiments, configurations with equivalent functions to configurations of the sign 10 of the first exemplary embodiment are allocated the same reference numerals, and duplicate explanation of configurations having the same reference numerals is omitted.

Sign Configuration with Upper Case Letters as Symbol Portions

Figure 5A:
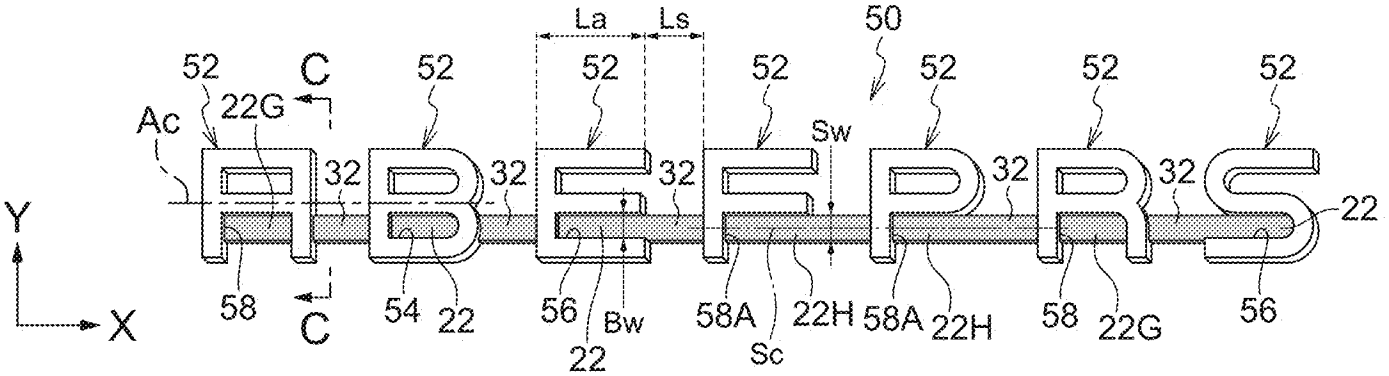
FIGS. 5A, 5B, 5C are front views of signs according to a second exemplary embodiment of the present invention.

As shown in FIG. 5A, a sign 50 according to the second exemplary embodiment includes plural symbol portions 52 arrayed in a straight line with the array direction in the arrow X direction, similarly to the sign 10 according to the first exemplary embodiment. Adjacent symbol portions 52 in the array direction are spaced at uniform intervals apart from each other, and are coupled together by coupling portions 32. Similarly to the sign 10, in the sign 50, regions in the array direction corresponding to the symbol portions 52 are indicated by the reference numerals La, and in the same direction, regions corresponding to the coupling portions 32 are indicated by the reference numerals Ls.

In the sign 50, similarly to the sign 10, the symbol portions 52 are configured by principal upper case letters. More specifically, the sign 50 is configured by an array of symbol portions 52 for the upper case letters "A", "B", "E", "F", "P", "R", and "S". Blank regions 54 with closed shape (periphery enclosed shape) are provided inside the symbol portions 52 for the upper case letters "A", "B", "P", and "R". In the present exemplary embodiment, reinforcement portions 22 are not provided to the blank regions 54 positioned at array width direction upper portions of the symbol portions 52, however a reinforcement portion 22 is provided to the blank region 54 positioned at an array width direction lower portion of the symbol 52 for the upper case letter "B". Blank regions 56 with an opened shape opening in the array direction are provided inside the symbol portions 52 for the upper case letters "E", "F", and "S". In the present exemplary embodiment, reinforcement portions 22 are not provided to the blank regions 56 positioned at array width direction upper portions of the symbol portions 52, however reinforcement portions 22 are provided to the blank regions 56 positioned at array width direction lower portions of the symbol portions 52 for the upper case letters "E" and "S". Moreover, blank regions 58 with an opened shape opening in the array width direction and positioned in array width direction lower portions are provided inside the symbol portions 52 for the upper case letters "A" and "R", and reinforcement portions 22G are provided in the blank regions 58. Blank regions 58A with an opened shape opening in the array direction and in the array width direction and positioned in array width direction lower portions are provided inside the symbol portions 52 for the upper case letters "F" and "P", and reinforcement portions 22H are provided in the blank regions 58A. Similarly to in the sign 10, there is no limitation of the upper case letters configuring the sign 50 to the symbol portions 52 for the letters "A" etc.

mentioned above, and the sign 50 may be configured including symbol portions 52 for other upper case letters.

Similarly to the coupling portions 30 of the sign 10, the array width direction positions of the coupling portions 32 of the sign 50 between adjacent symbol portions 52 in the array direction coincide with (are aligned with) the array width direction positions of the reinforcement portions 22, and the coupling portions 32 are provided with the same width as the reinforcement portions 22 in the present example. The array width direction coupling width Sw of the coupling portions 32 is set to the same width as the array width direction reinforcement width Bw of the reinforcement portions 22. The center position Sc of the coupling width Sw coincides with center position Bc of the reinforcement width Bw.

The cross-section structures of the symbol portions 52, the reinforcement portions 22, and the coupling portions 32 of the sign 50 are the same as the cross-section structures of the symbol portions 12, the reinforcement portions 20, and the coupling portions 30 of the sign 10 shown in FIG. 3A. Namely, in the symbol portion 52, a front face (52B) of a symbol body (52A) is provided with a surface-processed layer. Moreover, two surface-processed layers are provided on the front face of reinforcement body of the reinforcement portion 22, and two surface-processed layers are provided on the front face of coupling body of the coupling portion 32. Note that the reinforcement portions 22G and the reinforcement portions 22H are the same configuration to the reinforcement portions 22.

Figure 6A:
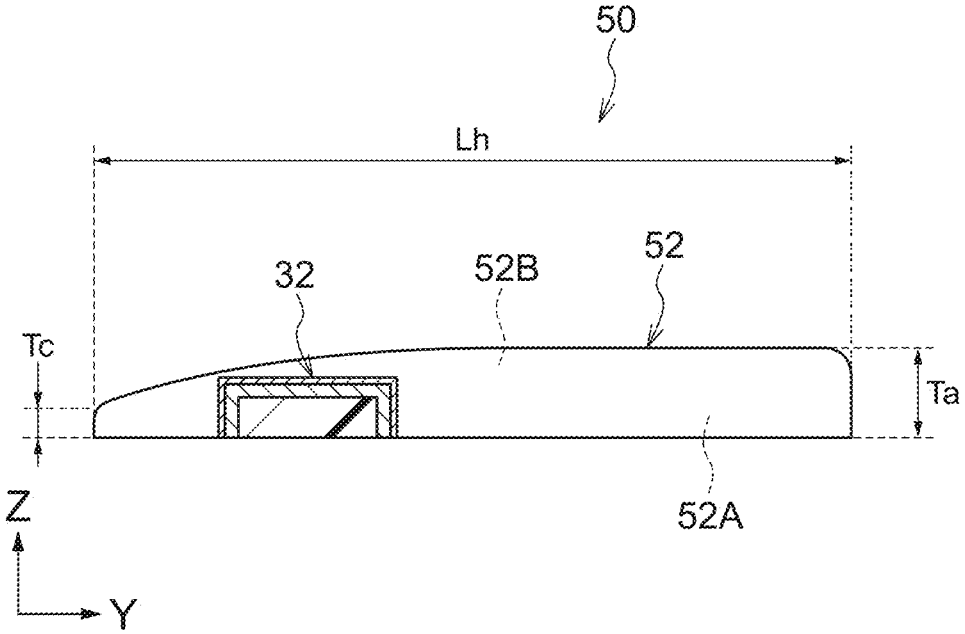
FIG. 6A is a side view and partial cross-section of a sign taken along an array width direction (along line C-C) of a symbol portion shown in FIG. 5A.

As shown in FIG. 6A, in the symbol portion 52 of the sign 50, a symbol thickness Ta changes to a symbol thickness Tc thinner than Ta on progression from the array width direction upper portion toward the array width direction lower portion (along the symbol height Lh), and the front face 52B of the symbol body 52A is formed with a projecting curved face shape. Note that the symbol portions 52 of the sign 50 may also be configured with a uniform symbol thickness Ta over the array width direction, similarly to the symbol portions 12 of the sign 10 shown in FIG. 3B.

Sign Configuration with Lower Case Letter as Symbol Portions

Figure 5B:
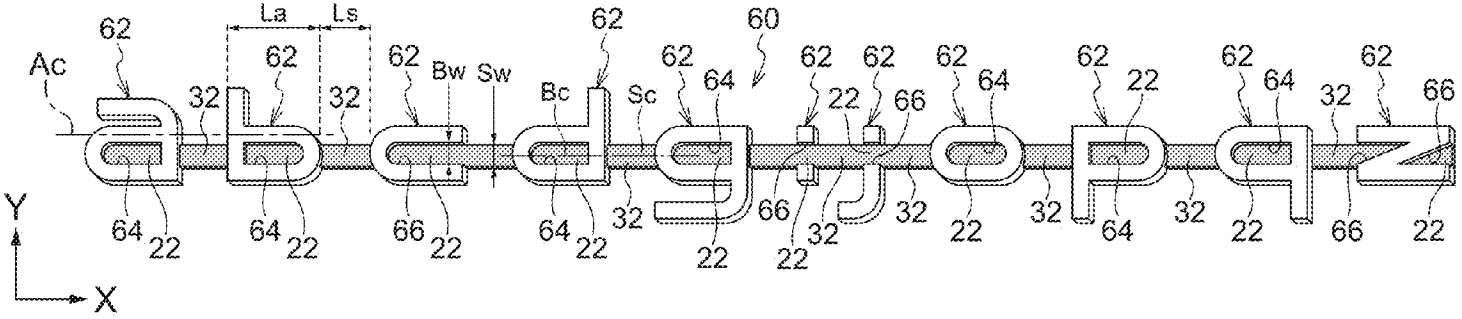

A sign 60 according to the second exemplary embodiment shown in FIG. 5B includes plural symbol portions 62 arrayed in a straight line with the array direction in the arrow X direction, similarly to the sign 50. Adjacent symbol portions 62 in the array direction are spaced at uniform intervals apart from each other, and are coupled together by the coupling portions 32. Similarly to the sign 50, in the sign 60, regions in the array direction corresponding to the symbol portions 62 are indicated by the reference numerals La, and in the same direction, regions corresponding to the coupling portions 32 are indicated by the reference numerals Ls.

In the sign 60 of the present exemplary embodiment, the symbol portions 62 are configured by principal lower case letters (small letters of the Roman alphabet). More specifically, the sign 60 is configured by an array of symbol portions 62 for the lower case letters "a", "b", "c", "d", "g", "i", "j", "o", "p", "q", and "z". Blank regions 64 with an enclosed shape (periphery enclosed shape) are provided inside the symbol portions 62 for the lower case letters "a", "b", "d", "g", "o", "p", and "q". In the present exemplary embodiment, reinforcement portions 22 are provided to the blank regions 64 of the symbol portions 62. Note that the positions of the blank regions 64 of the symbol portions 62 in the array width direction are the same as (correspond to) the positions of the blank regions 54 which is at the array width direction lower portion of the symbol portions 52 shown in FIG. 5A. The reinforcement portions 22 provided to the blank regions 64 are therefore equivalent to (similar to) the reinforcement portions 22 provided to the blank regions 54. Blank regions 66 with an opened shape opening in the array direction are provided inside the symbol portions 62 for the lower case letters "c" "i" "j", and "z". The blank regions 66 of the symbol portions 62 are provided with the reinforcement portions 22. Similarly to in the sign 50, there is no limitation of the lower case letters configuring the sign 60 to the symbol portions 62 for the letters "a" etc. described above, and the sign 60 may be configured including symbol portions 62 for other lower case letters.

Similarly to the coupling portions 32 of the sign 50, the array width direction positions of the coupling portions 32 of the sign 60 between adjacent symbol portions 62 in the array direction coincide with (are aligned with) the array width direction positions of the reinforcement portions 22, and the coupling portions 32 are provided with the same width as the reinforcement portions 22 in the present example. The array width direction coupling width Sw of the coupling portions 32 is the same as the array width direction reinforcement width Bw of the reinforcement portions 22. Moreover, the center position Sc of the coupling width Sw coincides with the center position Bc of the reinforcement width Bw.

The cross-section structures of the symbol portions 62, the reinforcement portions 22, and the coupling portions 32 of the sign 60 are the same as the cross-section structures of the symbol portions 52, the reinforcement portions 22, and the coupling portions 32 of the sign 50 (see FIG. 3A and FIG. 6A).

Sign Configuration with Numbers as Symbol Portions

Figure 5C:
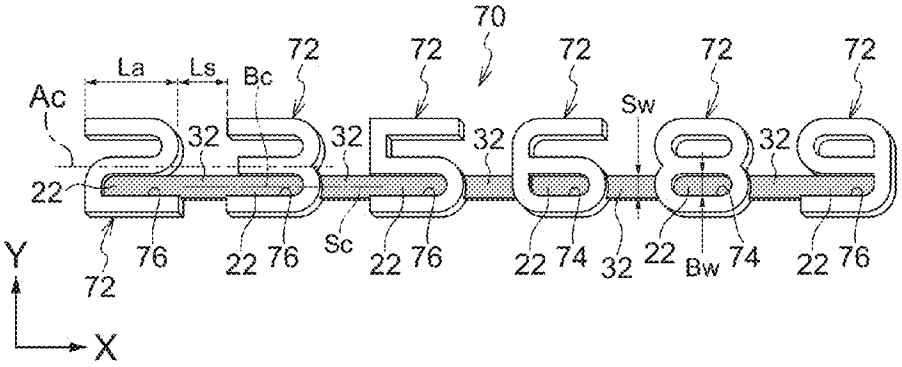

A sign 70 according to the second exemplary embodiment shown in FIG. 5C includes plural symbol portions 72 arrayed in a straight line with the array direction in the arrow X direction, similarly to in the sign 40 shown in FIG. 1B. Adjacent symbol portions 72 adjacent in the array direction are spaced at uniform intervals apart from each other, and are coupled together by coupling portions 32. Similarly to the sign 50, in the sign 70, regions in the array direction corresponding to the symbol portions 72 are indicated by the reference numerals La, and in the same direction, regions corresponding to the coupling portions 32 are indicated by the reference numerals Ls.

Similarly to the sign 40 shown in FIG. 1B, in the sign 70 of the present exemplary embodiment, the symbol portions 72 are configured by principal numbers. More specifically, the sign 70 is configured by an array of symbol portions 72 for the numbers "2", "3", "5", "6", "8", and "9". Blank regions 74 with an enclosed shape (periphery enclosed shape) are provided inside the symbol portions 72 for the numbers "6" and "8". In the present exemplary embodiment, reinforcement portions 22 are provided in the blank regions 74 positioned in array width direction lower portions of the symbol portions 72. Note that although blank regions are also provided at array width direction upper portions inside the symbol portions 72 for the numbers "8" and "9", the reinforcement portions 22 are not provided to these blank regions. Blank regions 76 with an opened shape opening in the array direction are provided inside the symbol portions 72 for the numbers "2", "3", "5", and "9". Similarly to the blank regions 74, in the present exemplary embodiment, reinforcement portions 22 are provided to the blank regions 76 positioned in array width direction lower portions of the symbol portions 72. Note that blank regions positioned at array width direction upper portions are also provided inside of the symbol portions 72 for the numbers "2", "3", "5", and "6"; however reinforcement portions 22 are not provided to these blank regions.

The numbers configuring the sign 70 are not limited to the symbol portions 72 for the number "2" etc. mentioned above, and symbol portions 72 for the other numbers "1", "4", "7", and "0", not shown in the drawings, may also be included. Note that similarly to in the sign 40 shown in FIG. 1B, symbol portions 72 for such other numbers are not provided with reinforcement portions 22.

Similarly to the coupling portions 32 of the sign 50, the array width direction positions of the coupling portions 32 of the sign 70 between adjacent symbol portions 72 in the array direction coincide with (are aligned with) the array width direction positions of the reinforcement portions 22, and the coupling portions 32 are provided with the same width as the reinforcement portions 22 in the present example. The array width direction coupling width Sw of the coupling portions 32 is the same width as the array width direction reinforcement width Bw of the reinforcement portions 20. The center position Sc of the coupling width Sw coincides with the center position Bc of the reinforcement width Bw.

The cross-section structures of the symbol portions 72, the reinforcement portions 22, and the coupling portions 32 of the sign 70 are the same as the cross-section structures of the symbol portions 52, the reinforcement portions 22 and the coupling portions 32 of the sign 50.

Modified Examples

Sign Configuration Combining Letters and Numbers

Figure 6B:
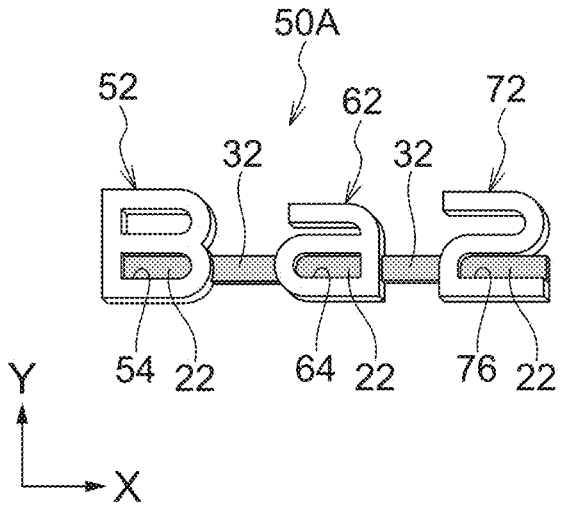
FIG. 6B is a front view of a sign according to a modified example including a symbol portion shown in FIG. 5A, a symbol portion shown in FIG. 5B, and a symbol portion shown in FIG. 5C.

A sign 50A shown in FIG. 6B is configured by a combination of the symbol 52 for the upper case letter "B" shown in FIG. 5A, the symbol 62 for the lower case letter "a" shown in FIG. 5B, and the symbol 72 for the number "2" shown in FIG. 5C. The blank region 54 is provided inside the symbol 52, and the reinforcement portion 22 is provided to the blank region 54. The blank region 64 is provided inside the symbol 62, and the reinforcement portion 22 is provided to the blank region 64. The blank region 76 is provided inside the symbol 72, and the reinforcement portion 22 is provided to the blank region 76. The symbol 52 and the symbol 62 are coupled together by the coupling portion 32 provided at an array width direction lower portion. Similarly, the symbol 62 and the symbol 72 are coupled together by the coupling portion 32 provided at an array width direction lower portion.

Figure 6C:
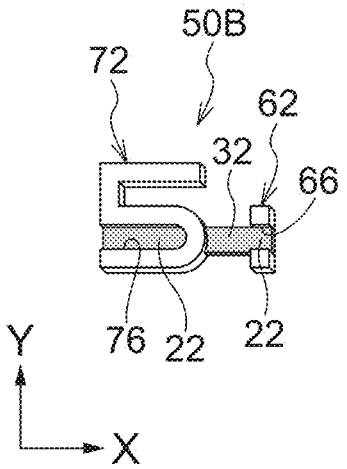
FIG. 6C is a front view of a sign according to a modified example including a symbol portion shown in FIG. 5C and a symbol portion shown in FIG. 5B.

A sign 50B shown in FIG. 6C is configured by a combination of the symbol 72 for the number "5" shown in FIG. 5C, and the symbol 62 for the lower case letter "i" shown in FIG. 5B. The blank region 76 is provided inside the symbol 72, and the reinforcement portion 22 is provided to the blank region 76. The blank region 66 is provided inside the symbol 62, and the reinforcement portion 22 is provided to the blank region 66. The symbol 72 and the symbol 62 are coupled together by the coupling portion 32 provided at an array width direction lower portion.

Operation and Advantageous Effects of the Present Exemplary Embodiment

The sign (upper case letters) 50 according to the present exemplary embodiment shown in FIG. 5A, the sign (lower case letters) 60 according to the present exemplary embodiment shown in FIG. 5B, and the sign (numbers) 70 according to the present exemplary embodiment shown in FIG. 5C are capable of obtaining similar operation and advantageous effects to the operation and advantageous effects obtained by the signs 10, 40 according to the first exemplary embodiment.

Moreover, as shown in FIG. 5A, in the sign 50 according to the present exemplary embodiment, the reinforcement portions 22 are provided to the blank regions 54 and blank regions 56 positioned at array width direction lower portions of the symbol portions 52, and the coupling portions 32 are provided at the array width direction positions same as the array width direction positions of the reinforcement portions 22. As shown in FIG. 6A, the sign 50 is configured with the symbol thickness Ta at the array width direction (symbol height Lh direction) upper portions of the symbol portions 52, and the symbol thickness Tc, at the array width direction lower portions, that is thinner than the symbol thickness Ta. Accordingly, although the rigidity of the symbol portions 52 is lower at the array width direction lower portions than at the array width direction upper portions, due to providing the reinforcement portions 22 at the array width direction lower portions of the symbol portions 52, and providing the coupling portions 32 at locations at the array width direction positions same as the array width direction positions of the reinforcement portions 22, the overall strength of the sign 50, including the symbol portions 52, can be increased. In addition, the front faces 52B of the symbol portions 52 are configured with projecting curved face shapes, enabling the symbol portions 52 to give a 3D (stereoscopic) appearance even when the viewing angle of the symbol portions 52 changes in the array width direction. This enables a further improvement to the design characteristics of the sign 50. Note that the sign 60 shown in FIG. 5B and the sign 70 shown in FIG. 5C are each capable of obtaining similar operation and advantageous effects to the operation and advantageous effects obtained by the sign 50.

Third Exemplary Embodiment

Figure 7A:
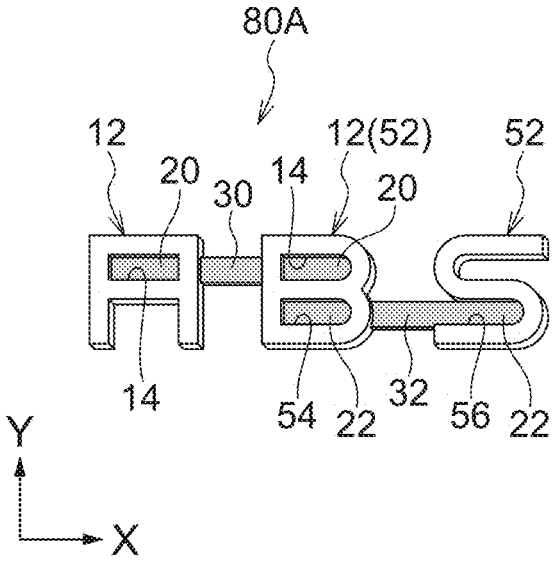
FIGS. 7A and 7B are front views of signs according to a third exemplary embodiment of the present invention.
Figure 7B:
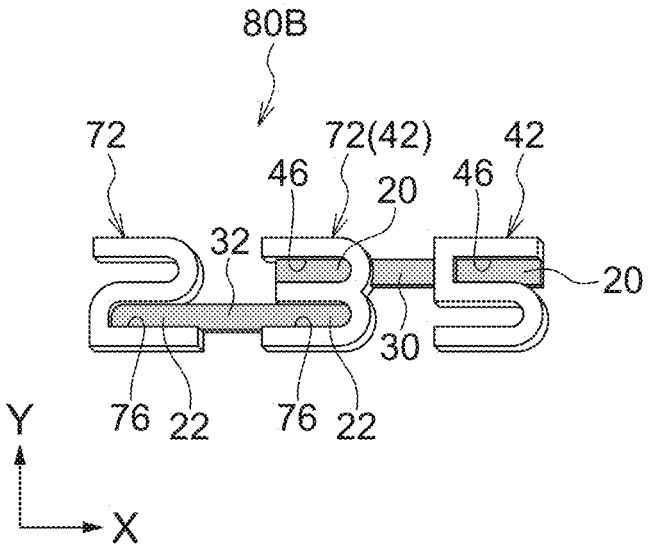

Explanation follows regarding signs according to a third exemplary embodiment of the present invention, with reference to FIGS. 7A and 7B. As shown in FIG. 7A, a sign 80A according to the present exemplary embodiment is configured by a combination of the sign 10 according to the first exemplary embodiment, and the sign 50 according to the second exemplary embodiment. More specifically, the sign 80A is configured by a combination of the symbol portions 12 for the upper case letters "A" and "B" shown in FIG. 1A, and the symbol portions 52 for the upper case letters "B" and "S" shown in FIG. 5A. The blank regions 14 are provided at array width direction upper portions inside the symbol portions 12 for the upper case letters "A" and "B", and the reinforcement portions 20 are provided to the blank regions 14. The symbol portions 12 are coupled together by the coupling portion 30 provided at an array width direction upper portion.

The symbol portion 12 for the upper case letter "B" is also used as a symbol 52 for the purpose of coupling to the symbol 52 for the upper case letter "S". The blank region 54 is provided at an array width direction lower portion inside the symbol 52 for the upper case letter "B", and the reinforcement portion 22 is provided to the blank region 54. The blank region 56 is provided at an array width direction lower portion inside the symbol 52 for the upper case letter "S", and the reinforcement portion 22 is provided to the blank region 56. The symbol portions 52 are coupled together by the coupling portion 32 provided at an array width direction lower portion.

A sign 80B according to the present exemplary embodiment shown in FIG. 7B is configured by a combination of the symbol portions 72 for the numbers "2" and "3" shown in FIG. 5C, and the symbol portions 42 for the numbers "3" and "5" shown in FIG. 1B. The blank regions 76 are provided at array width direction lower portions inside the symbol portions 72 for the numbers "2" and "3", and the reinforcement portions 22 are provided to the blank regions 76. The symbol portions 72 are coupled together by the coupling portion 32 provided at an array width direction lower portion.

The symbol 72 for the number "3" is also used as a symbol 42 for the purpose of coupling to the symbol 42 for the number "5". The blank region 46 is provided at an array width direction upper portion inside the symbol 42 for the number "3", and the reinforcement portion 20 is provided to the blank region 46. The blank region 46 is also provided at an array width direction upper portion inside the symbol 42 for the number "5", and the reinforcement portion 20 is provided to the blank region 46. The symbol portions 42 are coupled together by the coupling portion 30 provided at an array width direction upper portion.

Operation and Advantageous Effects of the Present Exemplary Embodiment

The sign 80A according to the present exemplary embodiment shown in FIG. 7A, and the sign 80B according to the present exemplary embodiment shown in FIG. 7B, are capable of obtaining similar operation and advantageous effects to the operation and advantageous effects obtained by the signs 10 and 40 according to the first exemplary embodiment, and the signs 50, 60, and 70 according to the second exemplary embodiment.

The sign 80A according to the present exemplary embodiment shown in FIG. 7A enables a sense of uniformity to be achieved between the overall form of the plural symbol portions 12 and the overall form of the reinforcement portions 20 and the coupling portion 30 provided at the array width direction upper portion. In addition, a sense of uniformity can be achieved between the overall form of the plural symbol portions 52 and the overall form of the reinforcement portions 22 and the coupling portion 32 provided at the array width direction lower portion. A further improvement in the design characteristics is enabled due to enabling a sense of uniformity to be achieved for the overall form of the sign 80A. Note that the sign 80B according to the present exemplary embodiment shown in FIG. 7B likewise obtains the operation and advantageous effect of enabling a further improvement to the design characteristics, similarly to the operation and advantageous effect obtained by the sign 80A according to the present exemplary embodiment.

Fourth Exemplary Embodiment

Figure 8A:
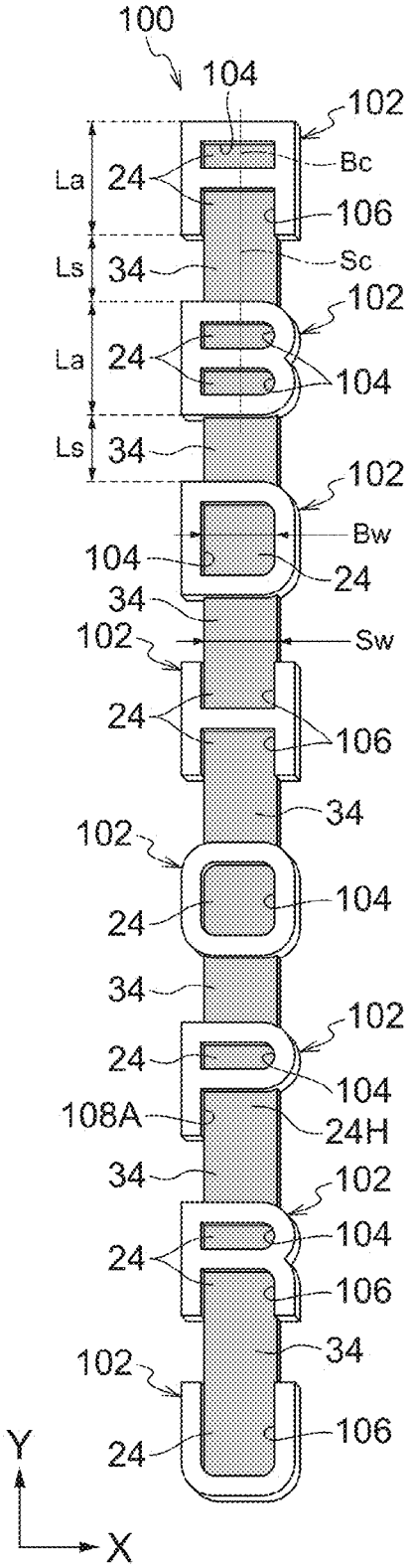
FIGS. 8A, 8B, 8C are front views of signs according to a fourth exemplary embodiment of the present invention.
Figure 8B:
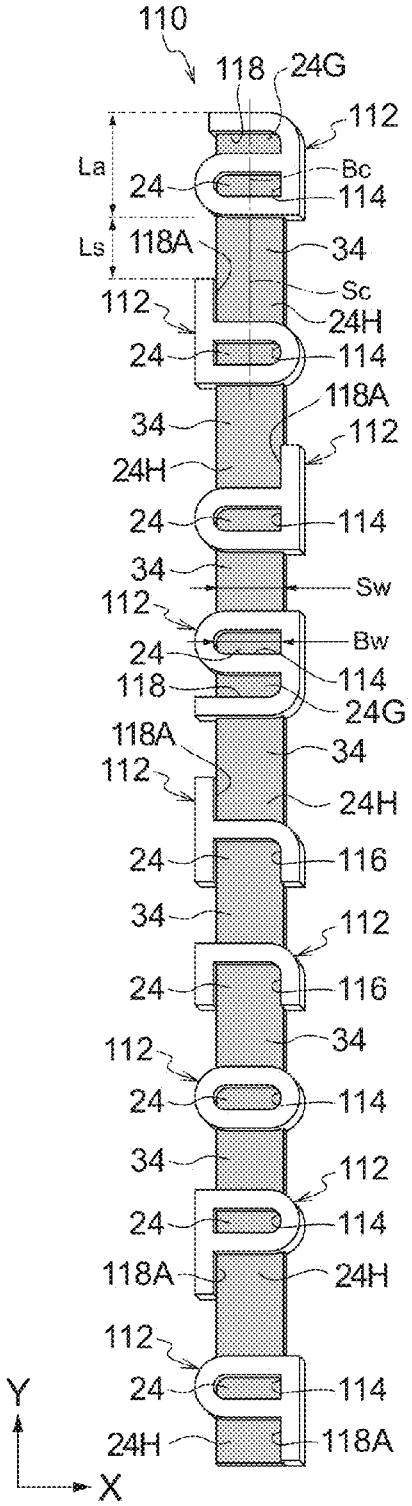
Figure 8C:
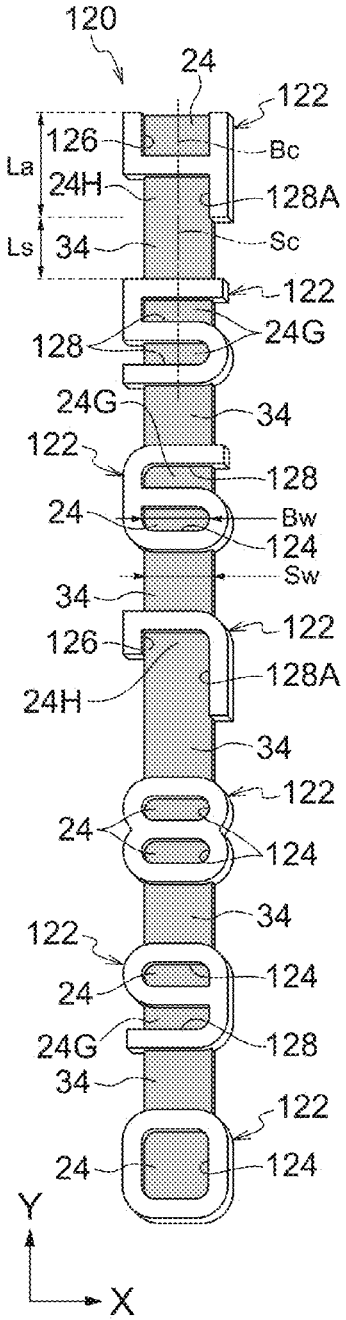

Explanation follows regarding a sign according to a fourth exemplary embodiment of the present invention, with reference to FIGS. 8A, 8B, 8C. In the fourth exemplary embodiment, explanation is given regarding an example in which the array direction of the sign symbol portions has been changed.

Sign Configuration with Upper Case Letters as Symbol Portions

As shown in FIG. 8A, a sign 100 according to the fourth exemplary embodiment has a different array direction to that of the sign 10 shown in FIG. 1A, for example. The sign 100 includes plural symbol portions 102 arrayed in a straight line with the arrow Y direction corresponding to the symbol height Lh direction shown in FIG. 2 as the array direction. Adjacent symbol portions 102 adjacent in the array direction are spaced at uniform intervals apart from each other, and are coupled together by coupling portions 34. Similarly to in the sign 10, in the sign 100, regions in the array direction corresponding to the symbol portions 102 are indicated by the reference numerals La, and in the same direction, regions corresponding to the coupling portions 34 are indicated by the reference numerals Ls.

In the sign 100, the symbol portions 102 are configured by principal upper case letters. More specifically, the sign 100 is configured by an array of symbol portions 102 for the upper case letters "A", "B", "D", "H", "O", "P", "R", and "U". Blank regions 104 with an enclosed shape (periphery enclosed shape) are provided inside the symbol portions 102 for the upper case letters "A", "B", "D", "O", "P", and "R", and reinforcement portions 24 are provided to the blank regions 104. Blank regions 106 with an opened shape opening in the array direction are provided inside the symbol portions 102 for the upper case letters "H", "R", and "U", and reinforcement portions 24 are provided to the blank regions 106. In the present exemplary embodiment, a blank region 108A with an opened shape opening in both the array direction and the array width direction is provided inside the symbol 102 for the upper case letter "P", and a reinforcement portion 24H is provided to the blank region 108A. Similarly to the sign 10 shown in FIG. 1A, for example, there is no limitation of the upper case letters configuring the sign 100 to the symbol portions 102 for "A" etc. mentioned above, and the sign 100 may be configured including symbol portions 102 for other upper case letters.

Similarly to the coupling portions 30 of the sign 10, the array width direction positions of the coupling portions 34 of the sign 100 between adjacent symbol portions 102 adjacent in the array direction coincide with (are aligned with) the array width direction positions of the reinforcement portions 24, and the coupling portions 34 are provided with the same width as the reinforcement portions 24 in the present example. The array width direction coupling width Sw of the coupling portions 34 is the same as the array width direction reinforcement width Bw of the reinforcement portions 24. The center position Sc of the coupling width Sw coincides with the center position Bc of the reinforcement width Bw.

The cross-section structures of the symbol portions 102, the reinforcement portions 24, and the coupling portions 34 of the sign 100 are the same as the cross-section structures of the symbol portions 12, the reinforcement portions 20, and the coupling portions 30 of the sign 10 shown in FIG. 3A.

Sign Configuration with Lower Case Letters as Symbol Portions

A sign 110 according to the fourth exemplary embodiment shown in FIG. 8B includes plural symbol portions 112 arrayed in a straight line with the arrow Y direction as the array direction, similarly to in the sign 100. Adjacent symbol portions 112 adjacent in the array direction are spaced at uniform intervals apart from each other, and are coupled together by coupling portions 34. Similarly to the sign 100, in the sign 110, regions in the array direction corresponding to the symbol portions 112 are indicated by the reference numerals La, and in the same direction, regions corresponding to the coupling portions 34 are indicated by the reference numerals Ls.

In the sign 110, the symbol portions 112 are configured by principal lower case letters. More specifically, the sign 110 is configured by an array of symbol portions 112 for the lower case letters "a", "b", "d", "g", "h", "n", "o", "p", and "q". Blank regions 114 with an enclosed shape (periphery enclosed shape) are provided inside the symbol portions 112 for the lower case letters "a", "b", "d", "g", "o", "p", and "q", and reinforcement portions 24 are provided to the blank regions 114. Blank regions 116 with an opened shape opening in the array direction are provided inside the symbol portions 112 for the lower case letters "h" and "n", and reinforcement portions 24 are provided to the blank regions 116. In the present exemplary embodiment, blank regions 118 with an opened shape opening in the array width direction are provided inside the symbol portions 112 for the lower case letters "a" and "g". Reinforcement portions 24G are provided to the blank regions 118. Blank regions 118A with an opened shape opening in both the array direction and the array width direction are provided inside the symbol portions 112 for the lower case letters "b", "d", "h", "p", and "q". Reinforcement portions 24H are also provided to the blank regions 118A. Similarly to the sign 100, there is no limitation of the lower case letters configuring the sign 110 to the symbol portions 112 for "a" etc. mentioned above, and the sign 110 may be configured including symbol portions 112 for other lower case letters.

Similarly to the coupling portions 34 of the sign 100, the array width direction positions of the coupling portions 34 of the sign 110 between adjacent symbol portions 112 adjacent in the array direction coincide with (are aligned with) the array width direction positions of the reinforcement portions 24, and the coupling portions 34 are provided with the same width as the reinforcement portions 24 in the present example. The array width direction coupling width Sw of the coupling portions 34 is the same as the array width direction reinforcement width Bw of the reinforcement portions 24. The center position Sc of the coupling width Sw coincides with the center position Bc of the reinforcement width Bw.

The cross-section structures of the symbol portions 112, the reinforcement portions 24, and the coupling portions 34 of the sign 110 are the same as the cross-section structures of the symbol portions 102, the reinforcement portions 24, and the coupling portions 34 of the sign 100 (see FIG. 3A).

Sign Configuration with Numbers as Symbol Portions

A sign 120 according to the fourth exemplary embodiment shown in FIG. 8C includes plural symbol portions 122 arrayed in a straight line with the arrow Y direction as the array direction, similarly to in the sign 100. Adjacent symbol portions 122 adjacent in the array direction are spaced at uniform intervals apart from each other, and are coupled together by coupling portions 34. Similarly to the sign 100, in the sign 120, regions in the array direction corresponding to the symbol portions 122 are indicated by the reference numerals La, and in the same direction, regions corresponding to the coupling portions 34 are indicated by the reference numerals Ls.

In the sign 120, the symbol portions 122 are configured by principal numbers. More specifically, the sign 120 is configured by an array of symbol portions 122 for the numbers "4", "5", "6", "7", "8", "9", and "0". Blank regions 124 with an enclosed shape (periphery enclosed shape) are provided inside the symbol portions 122 for the numbers "6", "8", "9" and "0", and reinforcement portions 24 are provided to the blank regions 124. Moreover, a blank region 126 with an opened shape opening in the array direction is provided inside the symbol portion 122 for the number "4", and a reinforcement portion 24 is provided to the blank region 126. In the present exemplary embodiment, blank regions 128 with an opened shape opening in the array width direction are provided inside the symbol portions 122 for the numbers "5", "6", and "9". Reinforcement portions 24G are provided to the blank regions 128. Blank regions 128A with an opened shape opening in both the array direction and the array width direction are provided inside the symbol portions 122 for the numbers "4" and "7". Reinforcement portions 24H are provided to the blank regions 128A. The numbers configuring the sign 120 are not limited to the symbol portions 122 for "4" etc. described above, and may also include symbol portions 122 for the other numbers "1", "2", and "3", not shown in the drawings.

Similarly to the coupling portions 34 of the sign 100, the array width direction positions of the coupling portions 34 of the sign 120 between adjacent symbol portions 122 adjacent in the array direction coincide with (are aligned with) the array width direction positions of the reinforcement portions 24, and the coupling portions 34 are provided with the same width as the reinforcement portions 24 in the present example. The array width direction coupling width Sw of the coupling portions 34 is the same as the array width direction reinforcement width Bw of the reinforcement portions 22. The center position Sc of the coupling width Sw coincides with the center position Bc of the reinforcement width Bw.

The cross-section structures of the symbol portions 122, the reinforcement portions 24, and the coupling portions 34 of the sign 120 are the same as the cross-section structures of the symbol portions 102, the reinforcement portions 24 and the coupling portions 34 of the sign 100.

Operation and Advantageous Effects of the Present Exemplary Embodiment

The sign (upper case letters) 100 according to the present exemplary embodiment shown in FIG. 8A, the sign (lower case letters) 110 according to the present exemplary embodiment shown in FIG. 8B, and the sign (numbers) 120 according to the present exemplary embodiment shown in FIG. 8C are capable of obtaining similar operation and advantageous effects to the operation and advantageous effects obtained by the signs 10, 40 according to the first exemplary embodiment, even though the array direction of the symbol portions 102, 112, 122 has been changed.

Fifth Exemplary Embodiment

Figure 9:
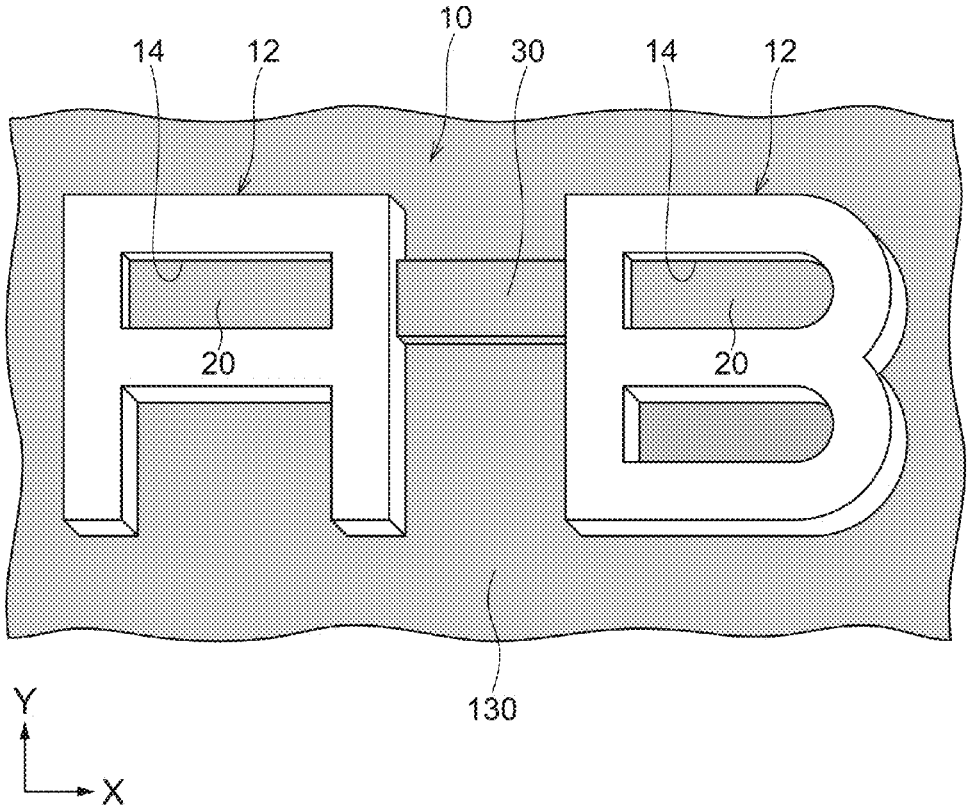
FIG. 9 is an enlarged front view, corresponding to FIGS. 4A and 4B, showing relevant portions of a sign according to a fifth exemplary embodiment of the present invention.

Explanation follows regarding a sign according to a fifth exemplary embodiment of the present invention, with reference to FIG. 9. As shown in FIG. 9, in the present exemplary embodiment, the sign 10 shown in FIG. 2 described above is attached to an attachment body 130. In a case in which the vehicle is a car, for example, the attachment body 130 is interior decor (interior section) such as an instrument panel or a steering wheel, or exterior decor (exterior section) such as a quarter panel, a trunk panel, or a back door. In cases in which the vehicle is a motorbike, the attachment body 130 is interior decor such as a meter panel, or an exterior decor such as a fuel tank or cowl.

The surface color of the design faces of the reinforcement portions 20 and the coupling portion 30 of the sign 10 matches the surface color of at least a design face of the attachment body 130 peripheral to the reinforcement portions 20 and the coupling portion 30. More specifically, as shown in FIG. 3A, in the first exemplary embodiment, the design faces of the reinforcement portions 20 are coated black, for example, by the surface-processed layer 20F. As shown in FIG. 3A and FIG. 3B, design faces of the coupling portions 30 are coated black, for example, by the surface-processed layer 30F. The surface color as the design face of the attachment body 130 is colored black, for example. Note that there is no limitation to black, and in a case in which the design face of the attachment body 130 to be colored red, the design faces of the reinforcement portions 20 and the coupling portions 30 are coated red, and in a case in which the design face of the attachment body 130 to be colored blue, the design faces of the reinforcement portions 20 and the coupling portions 30 are coated blue.

There is no limitation to a colored coating, and in a case in which the design face of the attachment body 130 to be applied with texturing, the design faces of the reinforcement portions 20 and the coupling portions 30 are applied with texturing.

Operation and Advantageous Effect of the Present Exemplary Embodiment

The sign 10 according to the present exemplary embodiment is capable of obtaining similar operation and advantageous effects to the operation and advantageous effects obtained by the sign 10 according to the first exemplary embodiment. Moreover, as shown in FIG. 9, in the sign 10 according to the present exemplary embodiment, the design of the reinforcement portions 20 and the coupling portions 30 matches the design of the attachment body 130 to achieve a mask-design against the design of the attachment body 130 (to achieve a protection color when colored). The outlines of the symbol portions 12 are made clearer since the reinforcement portions 20 and the coupling portions 30 are not noticeable against the surface of the attachment body 130. The symbol portions 12 are accordingly made easier to read, thereby enabling an improvement in the visibility of the symbol portions 12.

Note that in the present exemplary embodiment, there is no limitation to the sign 10, and the signs 40, 50, 50A, 50B, 60, 70, 80A, 80B, 100, 110, and 120 are all applicable to the present exemplary embodiment.

Sixth Exemplary Embodiment

Figure 10:
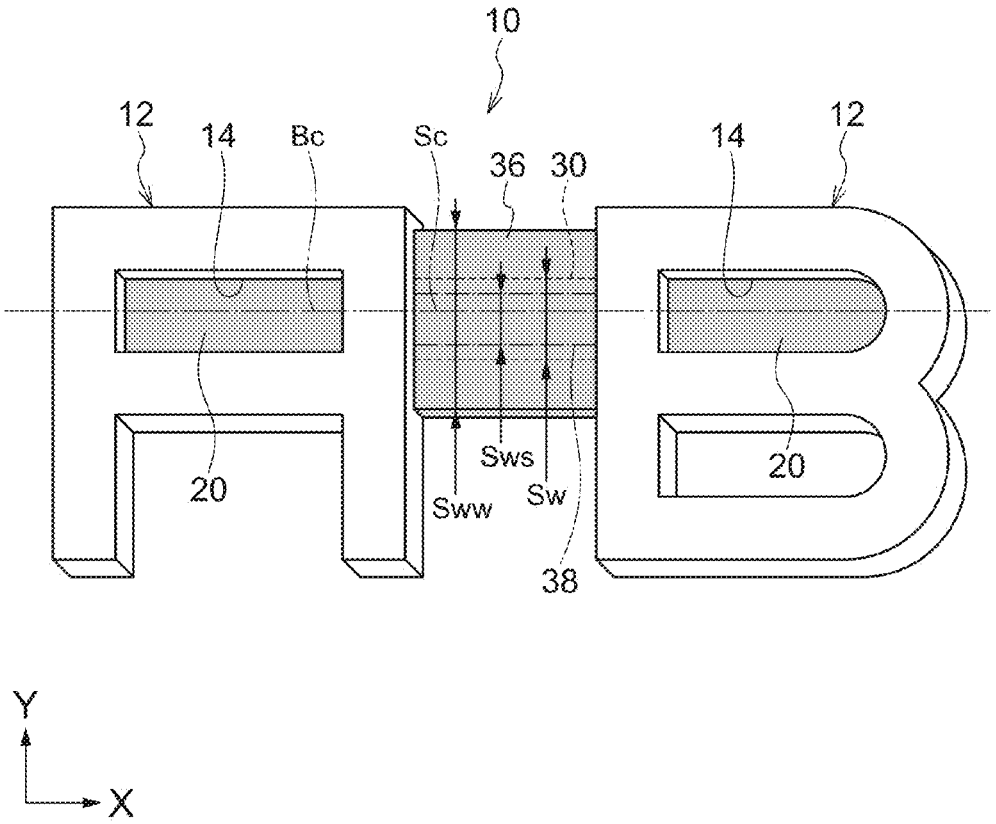
FIG. 10 is an enlarged front view, corresponding to FIGS. 4A and 4B, showing relevant portions of a sign according to a sixth exemplary embodiment of the present invention.

Explanation follows regarding a sign according to a sixth exemplary embodiment of the present invention, with reference to FIG. 10. As shown in FIG. 10, in the present exemplary embodiment, in the sign 10 shown in FIG. 2, the symbol portions 12 are coupled together by a coupling portion 36. The array width direction coupling width Sww of the coupling portion 36 is set larger than the reinforcement width Bw (see FIG. 2) of the reinforcement portions 20 in the same direction. The center position Sc of the coupling portion 36 coincides with the center position Bc of the reinforcement portions 20.

In the sign 10, the symbol portions 12 may be coupled together by a coupling portion 38 which is shown by a long dashed short dashed line. The array width direction coupling width Sws of the coupling portion 38 is set smaller than the reinforcement width Bw of the reinforcement portions 20 in the same direction. The center position Sc of the coupling portion 38 coincides with the center position Bc of the reinforcement portions 20.

Operation and Advantageous Effects of the Present Exemplary Embodiment

In the sign 10 according to the present exemplary embodiment, the symbol portions 12 are coupled together by the coupling portion 36 with the large coupling width Sww, thereby enabling a further increase in overall strength. Moreover, in the sign 10 according to the present exemplary embodiment, the center position Sc of the coupling portion 36 coincides with the center position Bc of the reinforcement portions 20, thereby enhancing the sense of uniformity of the shape, and enabling improved design characteristics.

Moreover, in the sign 10 according to the present exemplary embodiment, the symbol portions 12 are coupled together by the coupling portion 38 with the small coupling width Sws. However, providing the reinforcement portions 20 to the symbol portions 12 and providing the coupling portion 38 such that the array width direction position of the coupling portion 38 coincides with (is aligned with) the array width direction positions of the reinforcement portions 20, enabling an increase in overall strength. Moreover, in the sign 10 according to the present exemplary embodiment, the center position Sc of the coupling portion 38 coincides with the center position Bc of the reinforcement portions 20, thereby enhancing the sense of uniformity of the shape, and enabling improved design characteristics.

Additional Explanation Regarding Above Exemplary Embodiments

The present invention is not limited to the exemplary embodiments described above, and modifications such as the following may be implemented within a range not departing from the spirit of the present invention. For example, the present invention is not limited to the alphanumeric typesets (styles of type) and fonts of the symbol portions in the above exemplary embodiments. For example, the alphanumeric characters of the symbol portions may be in an italicized font. Moreover, in the above exemplary embodiments, explanation has been given regarding examples in which the present invention is applied to signs using alphanumeric characters, however in the present invention there is no limitation of the symbol text to Roman characters. The present invention may, for example, be applied to text in Chinese characters, Japanese characters (hiragana, katakana), Korean characters, or Arabic characters.

In the signs according to the exemplary embodiments described above, the array direction of the symbol portions is aligned with either the arrow X direction or the arrow Y direction, however in the present invention the array direction may be an inclined direction set in a range of ±45 degrees with respect to the arrow X direction, or set in a range of within ±45 degrees with respect to the arrow Y direction. In the signs according to the exemplary embodiments described above, the array width direction positions of the reinforcement portions and the array width direction positions of the coupling portions are coincided with each other, however in the present invention it is sufficient that at least a portion of the array width direction position of the reinforcement portion and the array width direction position of the coupling portion are coincided with each other. For example, it is sufficient that, in the array width direction (when seen along the array direction), the reinforcement portion and the coupling portion are overlapped at least portion thereof.

The present invention may be configured by a sign combining a sign according to the first exemplary embodiment and a sign according to the second exemplary embodiment. More specifically, a sign may be configured with reinforcement portions provided to blank regions inside upper case letter symbol portions at an array width direction upper portion, with coupling portions provided at positions coinciding with (corresponding to) the positions of the reinforcement portions, and also with reinforcement portions provided to blank regions inside the symbol portions at an array width direction lower portion, with coupling portions provided at positions coinciding with (corresponding to) the positions of the reinforcement portions. Namely, two coupling portions, respectively provided at the array width direction upper portion and the array width direction lower portion, may extend parallel to each other along the array direction.

In the present invention, a sign may be configured in which either or both out of the reinforcement portion and the coupling portion have a front face height set higher than the front face height of the symbol portion. Namely, a sign may be configured in which the reinforcement portions or the coupling portions project out further than the front faces of the symbol portions. Moreover, in the present invention, the front face height of location of the symbol portion between the reinforcement portion and the coupling portion may match the front face height of either or both out of the reinforcement portion and the coupling portion. In such a case, the design of such location on the symbol portion may match the design of the reinforcement portion and/or the coupling portion.

In the exemplary embodiments described above, explanation has been given regarding examples in which the present invention is applied to a sign attached to a vehicle, however application of the present invention is not limited to vehicles. For example, the present invention may also be applied to a portable key capable of locking and unlocking a door lock, or of starting and stopping an engine, without needing to insert, as an example of a vehicle related device. The present invention may also be applied to signs attached as logos to electronic devices, such as personal computers, handheld terminals, or mobile telephones, or to electrical goods such as monitors (televisions), refrigerators, washing machines, or the like, which are not directly related to vehicles. The present invention may also be applied to signs attached to decorative items such as bags, shoes, wristwatches, accessories or the like.

What is claimed is:

1. A sign comprising:

a plurality of symbol portions that are arrayed in an array direction, each of the symbol portions including a body;

at least one blank region being formed inside at least one symbol portion within either an enclosed or an open periphery thereof in the array direction in plan view;

a reinforcement portion that is provided at the blank region and that reinforces the symbol portion, and a coupling portion that couples the symbol portions together, the coupling portion being provided between the symbol portions such that a position of the coupling portion and a position of the reinforcement portion coincide with each other in an array width direction which is orthogonal to the array direction, wherein symbol portion bodies of the symbol portions, a reinforcement portion body of the reinforcement portion, and a coupling portion body of the coupling portion are integrally formed.

2. The sign of claim 1, wherein a center position in the array width direction of the coupling portion coincides with a center position in the array width direction of the reinforcement portion.

3. The sign of claim 1, wherein:

the blank regions are provided at the symbol portion on both sides with respect to a center position in the array width direction of the symbol portion, and the reinforcement portion is provided at one of the blank regions, a position in the array width direction of the one of the blank regions coinciding with a position in the array width direction of the coupling portion.

4. The sign of claim 2, wherein:

the blank regions are provided at the symbol portion on both sides with respect to a center position in the array width direction of the symbol portion, and the reinforcement portion is provided at one of the blank regions, a position in the array width direction of the one of the blank regions coinciding with a position in the array width direction of the coupling portion.

5. The sign of claim 1, wherein a design of the reinforcement portion and of the coupling portion differs from a design of the symbol portion.

6. The sign of claim 5, wherein the symbol portion, the reinforcement portion, and the coupling portion are attachable to an attachment body, and the design of the reinforcement portion and of the coupling portion matches a design of the attachment body at a periphery of the reinforcement portion and the coupling portion.

7. The sign of claim 1, wherein a width in the array width direction of the coupling portion is the same as a width in the array width direction of the reinforcement portion.

8. The sign of claim 2, wherein a width in the array width direction of the coupling portion is the same as a width in the array width direction of the reinforcement portion.

9. A sign comprising:

a plurality of symbol portions that are arrayed in an array direction, each of the symbol portions including a body;

a blank region being formed inside at least one symbol portion within either an enclosed or an open periphery thereof at least of one in the array direction or in an array width direction which is orthogonal to the array direction in plan view;

a reinforcement portion that is provided at the blank region and that reinforces the symbol portion, and a coupling portion that couples the symbol portions together, the coupling portion being provided between the symbol portions such that a position of the coupling portion and a position of the reinforcement portion coincide with each other in an array width direction which is orthogonal to the array direction, wherein symbol portion bodies of the symbol portions, a reinforcement portion body of the reinforcement portion, and a coupling portion body of the coupling portion are integrally formed.

10. The sign of claim 1, wherein the symbol portion bodies configure the shapes of symbols represented by the respective symbol portions.

11. The sign of claim 9, wherein the symbol portion bodies configure the shapes of symbols represented by the respective symbol portions.

12. A sign comprising:

a plurality of symbol portions that are arrayed in an array direction, each of the symbol portions including a body;

a blank region being formed inside at least one symbol portion within either an enclosed or an open periphery thereof at least of one in the array direction or in an array width direction which is orthogonal to the array direction in plan view;

a reinforcement portion that is provided at the blank region and that reinforces the symbol portion, and a coupling portion that couples the symbol portions together, the coupling portion being provided between the symbol portions such that a position of the coupling portion and a position of the reinforcement portion coincide with each other in the array width direction, wherein, if the symbol portion has a blank region, at least one reinforcement portion is provided at the blank region, and wherein, for every symbol portion having one or more blank regions, the reinforcement portion is provided at at least one blank region.

13. A sign comprising:

a plurality of symbol portions that are arrayed in an array direction, each of the symbol portions including a body;

a reinforcement portion that is provided at a blank region formed by the symbol portion within either an enclosed or an open periphery thereof in the array direction in plan view and that reinforces the symbol portion, the reinforcement portion not being provided at a blank region being opened in an array width direction which is orthogonal to the array direction in the plan view, and a coupling portion that couples the symbol portions together, the coupling portion being provided between the symbol portions such that a position of the coupling portion and a position of the reinforcement portion coincide with each other in the array width direction.

* * * * *